United States Patent [19]

Richter

[11] 4,180,028

[45] Dec. 25, 1979

[54] FLUID OPERATED DEVICE

[76] Inventor: Paul A. Richter, 1 Hammersley Pl., Fisher, Australia

[21] Appl. No.: 703,984

[22] Filed: Jul. 9, 1976

[30] Foreign Application Priority Data

| | | | |
|---|---|---|---|
| Jul. 11, 1975 | [AU] | Australia | 2333 |
| Nov. 7, 1975 | [AU] | Australia | 3883 |
| Jan. 14, 1976 | [AU] | Australia | 10299 |

[51] Int. Cl.[2] ..... F02B 53/06; F01L 7/04

[52] U.S. Cl. ..... 123/45 A; 123/51 A; 123/58 C; 123/80 C; 123/108 C; 123/190 C; 123/197 A

[58] Field of Search ..... 123/45 R, 45 A, 51 A, 123/51 R, 51 AA, 58 R, 80 C, 188 C, 190 C, 197 A, 52 B, 58 C; 92/106

[56] References Cited

U.S. PATENT DOCUMENTS

| | | | |
|---|---|---|---|
| 1,229,438 | 6/1917 | Frech | 123/80 C |
| 1,613,136 | 1/1927 | Schieffelin | 123/45 A |
| 2,386,607 | 10/1945 | Heintz | 123/80 C |
| 2,532,106 | 11/1950 | Korsgen | 123/58 C |
| 2,781,748 | 2/1957 | Stucke | 123/190 C |
| 3,598,094 | 8/1971 | Odawara | 123/58 C |

FOREIGN PATENT DOCUMENTS

| | | | |
|---|---|---|---|
| 2300587 | 7/1974 | Fed. Rep. of Germany | 123/45 A |

*Primary Examiner*—Charles J. Myhre
*Assistant Examiner*—Craig R. Feinberg
*Attorney, Agent, or Firm*—Sughrue, Rothwell, Mion, Zinn & Macpeak

[57] ABSTRACT

A fluid operated device comprises a cylinder, a piston movable axially therein, a shaft parallel to the axis of the cylinder and coupling means coupling the piston and cylinder and/or the piston and shaft in such a way that axial reciprocation of the piston causes rotation of the cylinder and/or the shaft.

10 Claims, 33 Drawing Figures

I
II
-110-
-101-
-102-
-103-

400C
400D
400B
400A
401C
401D
401B
401A
402D
502
503
501
504
505
506
431
432
433
434
435
436
441
442
443
444
445
446
447
421
422
423
424
425
411
412
413
414

FLUID OPERATED DEVICE

This invention relates to a fluid operated engine or motor and particularly to such a device which is capable of producing rotary motion of a shaft to power motor vehicles, farm machinery, stationary devices such as generators and so on.

In particular, the engine or motor of this invention is capable of being operated by a wide range of fluids and in fact may be operated with any type of expandable fluid, whether or not prior ignition is required. Thus, the device may be operated with a compressed or pressurised fluid such as air, steam or helium which is allowed to expand, or alternatively the motor may be operated with fluids such as petrol, gas or other hydrocarbon or similar fuel which require ignition to cause the necessary expansion.

It is an advantage of the present invention, when compared with the usual internal combustion engines presently used, that the device of this invention produces rotary motion of a shaft directly whereas the engines presently used in motor vehicles and the like produce only reciprocating motion of the piston which is utilised to rotate a camshaft or the like to provide the necessary rotation of the drive shaft.

Alternatively, of course, if the device of this invention is mounted so as to be free to rotate, the shaft thereof may be fixed and the device itself will rotate around the shaft.

According to this invention, there is provided a fluid operated device comprising a cylinder, a piston movable axially therein, a shaft parallel to the axis of the cylinder and coupling means coupling the piston and cylinder and/or the piston and shaft in such way that axial reciprocation of the piston causes rotation of the cylinder and/or the shaft.

In one embodiment, the coupling means couples the piston and cylinder such that axial reciprocation of the piston causes rotation thereof, the shaft being mounted to extend into the cylinder for rotation with the piston. Alternatively the coupling means may couple the piston and shaft such that axial reciprocation of the piston (without rotation thereof) causes rotation of the shaft. Preferably, the shaft is coaxial with the piston and cylinder.

In yet another embodiment, coupling means may be provided coupling the piston and the cylinder such that axial reciprocation of the piston causes rotation thereof, the piston also being coupled to the shaft such that said axial reciprocation of the piston causes rotation of the shaft in addition to the rotation imparted by rotation of the piston.

In an alternative arrangement of the above embodiment, the shaft may be held fixed so that rotation is imparted to the piston and cylinder about the shaft.

The coupling means preferably comprises a cam and cam follower. In one embodiment the cam may comprise at least one continuous sinusoidal or similar guideway of generally square or rectangular section formed into the inner surface of the cylinder and the cam follower comprises one or more members projecting radially from the piston and received within the guideway. Several guideways and associated cam followers may be provided to give added performance and reliability. The projecting members may comprise rollers mounted for rotation about axes which are radial with respect to the piston. Alternatively, the guideway may be formed into the outer surface of the piston and/or shaft with the cam followers projecting radially inwardly from the cylinder and/or piston.

In a further embodiment, the cam may comprise at least one continuous sinusoidal or similar guideway of generally semi-circular section formed into the outer wall of the shaft or piston or the inner wall of the piston or cylinder, and the cam follower comprises one or more bearing balls mounted, either directly or by mounting means, in the facing wall of the piston, cylinder or shaft to project radially therefrom and engage the guideway.

In yet another embodiment, the cam may comprise a cammed surface which provides a continuous sinusoidal or similar guideway with the cam follower being mounted to move along this surface.

Preferably, the axial position of the shaft is fixed relative to the cylinder, and in one embodiment the shaft may be connected by intermeshing splines to the piston. The shaft may have mounted thereon a disc member, the outer part of which is received within a circumferential groove provided in the cylinder to fix the axial position of the shaft relative to the cylinder. The said outer part of the disc member may include openings therethrough which cooperate with fluids ducts formed in the cylinder for controlling the flow of fluid to and/or from the interior of the cylinder.

In a simple form of the motor, the guideway comprises a single "wave" of a sinusoid so that the piston will perform half a revolution during a pressure stroke of the piston, and will perform half a revolution in the same sense during the return stroke, the return stroke being effected by the angular momentum of the rotating parts. In a more sophisticated arrangement, the "return" stroke is a pressure stroke effected by introducing fluid under pressure to the other end of the piston whereby there are two pressure strokes in opposite axial directions for each complete revolution of the piston.

In further alternative embodiments, the axial position of the shaft is fixed relative to the cylinder, however the connection of the shaft to the piston by intermeshing splines is replaced by a coupling means as previously described such that axial reciprocation of the piston causes rotation of the shaft. In these embodiments, the piston may be coupled to the cylinder either to prevent relative rotation thereof whilst still permitting said axial reciprocation of the piston, or alternatively by means of further coupling means such that said axial reciprocation of the piston causes relative rotation of the piston and cylinder also.

In yet another embodiment, the coupling means comprises first coupling means coupling the piston and cylinder such that axial reciprocation of the piston causes rotation thereof, and second coupling means to couple the piston and shaft such that rotation of the piston causes rotation of the shaft advantageously at a rate of rotation greater than the rate of rotation of the piston. Preferably, the shaft is coaxial with the piston and cylinder.

Preferably, the first coupling means comprises a cam and cam follower as previously described. The second coupling means preferably comprises a gear carrier mounted within the piston, having the shaft extending coaxially therethrough and provided with at least one idler gear member extending between, and interacting by means of intermeshing splines with, the piston and the shaft. Preferably, a plurality of idler gear members are provided and such members are arranged in a balanced manner in the gear carrier.

In this embodiment, the piston is provided with an internal chamber through which the shaft extends and within which the gear carrier is mounted. Around the internal surface of this chamber, the piston is provided with a splined area, the splines thereof intermeshing with the splines of the or each idler gear member. Since the movement of the piston is both axially reciprocating and rotating, the intermeshing of the splines in the piston chamber and on the idler gear members permits axial movement of the piston relative to the idler gear members but ensures rotation of the idler gear members in unison with rotation of the piston. Suitable selection of the ratios of numbers of splines on the inner surface of the piston chamber and on the idler gear members can be employed to obtain more than a single revolution of the idler gear members for each revolution of the piston. As previously described, the splines on the idler gear members also intermesh with splines on the shaft to cause rotation of the shaft on rotation of the idler gear members. Again, suitable selection of the ratios of numbers of splines on the idler gear members and on the shaft can be employed to obtain more than a single revolution of the shaft for each revolution of the idler gear members.

In one form of the device of this embodiment, the piston is mounted for axial reciprocation, working chambers are provided at either end of the piston and the guideway comprises a single "wave" of a sinusoid so that the piston will perform half a revolution during a first pressure stroke of the piston effected by expansion of fluid in a working chamber within the cylinder at a first end of the piston, and will perform half a revolution in the same sense during the return pressure stroke, the return stroke being effected by expansion of fluid in a working chamber at the other end of the piston whereby there are two pressure strokes in opposite axial directions for each complete revolution of the piston.

In an alternative and preferred arrangement, the guideway comprises two "waves" of a sinusoid so that projecting members may be provided on diametrically opposite sides of the piston or cylinder, each being received within a corresponding portion of one of the waves of the guideway in the cylinder or piston, respectively. In this embodiment, the piston will perform a quarter revolution during a first pressure stroke effected by expansion of fluid in the working chamber at one end of the piston, and a further quarter revolution in the same sense during the return pressure stroke effected by expansion of fluid in the working chamber at the other end of the piston. There will thus be four pressure strokes in alternating opposite axial directions for each complete revolution of the piston.

It will be apparent that other configurations of guideways and projecting members are possible in accordance with this embodiment of the invention and many variations are possible. Thus a plurality of corresponding guideways may be provided spaced along the piston or cylinder.

The specific embodiments described above refer to an arrangement in which the piston is mounted for axial reciprocation and working chambers are provided at either end of the piston, pressure being exerted on the respective ends of the piston by expansion of fluid in alternating chambers. In a modification of this arrangement, one of these chambers may be simply a closed chamber containing fluid which will be compressed as the piston moves axially under the influence of expansion of fluid in the other, working chamber. When the pressure in the working chamber is relieved at the completion of axial movement of the piston in the first pressure stroke, the compressed fluid in the closed chamber will expand thereby moving the piston in the opposite axial direction in a return stroke. Such return stroke will also be assisted by the angular momentum of the rotating parts of the device.

Preferably a valving arrangement is provided for rotation with the piston to enable admission and removal of working fluid. Such valving arrangement in one embodiment consists of a control disc or discs constrained to rotate on rotation of the piston and including openings therethrough which cooperate with fluid ducts formed in the cylinder for controlling the flow of fluid to and/or from the working chambers of the motor.

The invention will now be described with reference to the accompanying drawings in which.

Figures 6, 6A, 7, 7A:
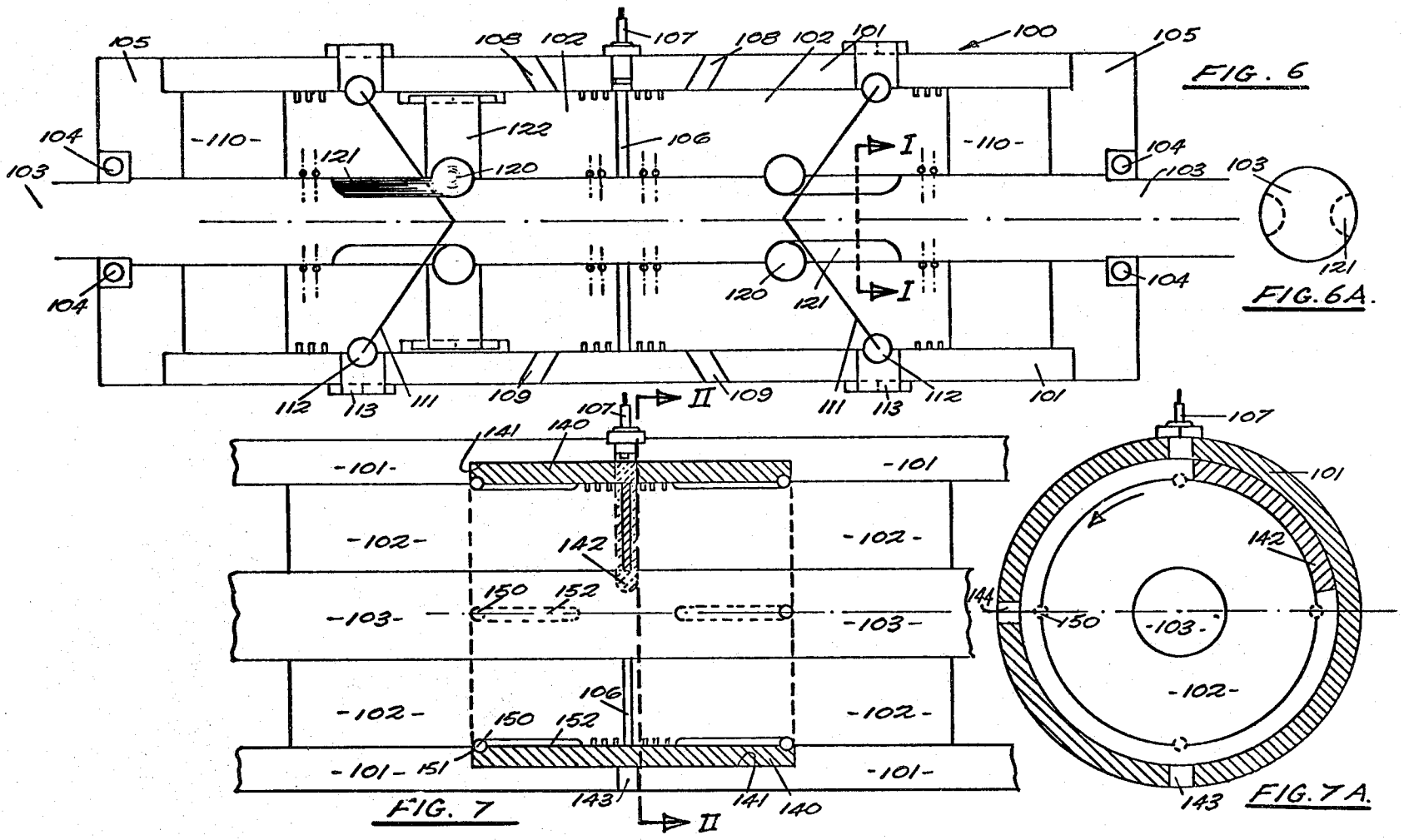
FIG. 6 shows a longitudinal cross-section through one further embodiment of engine or motor in accordance with the present invention.
Figures 10, 10A, 10B, 10C, 11, 11A:
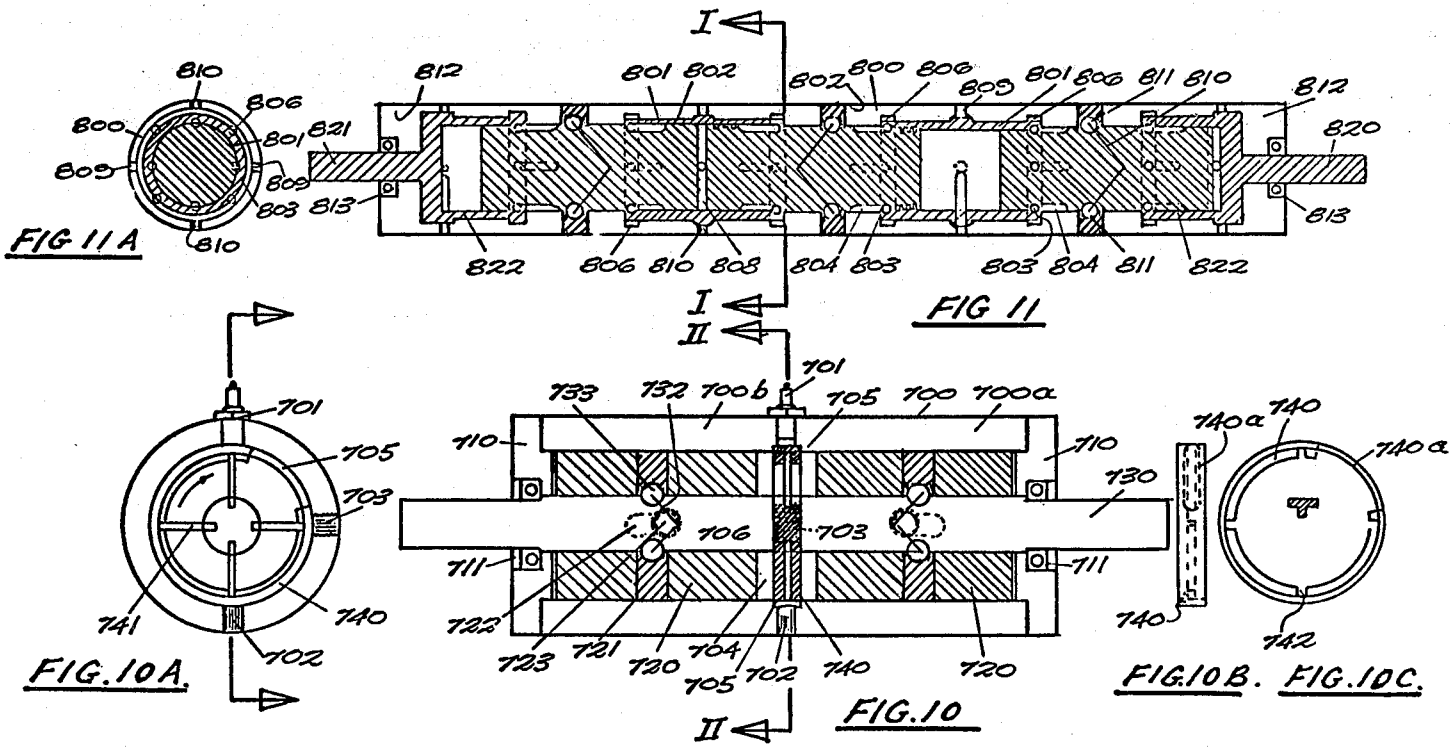
Figure 12:
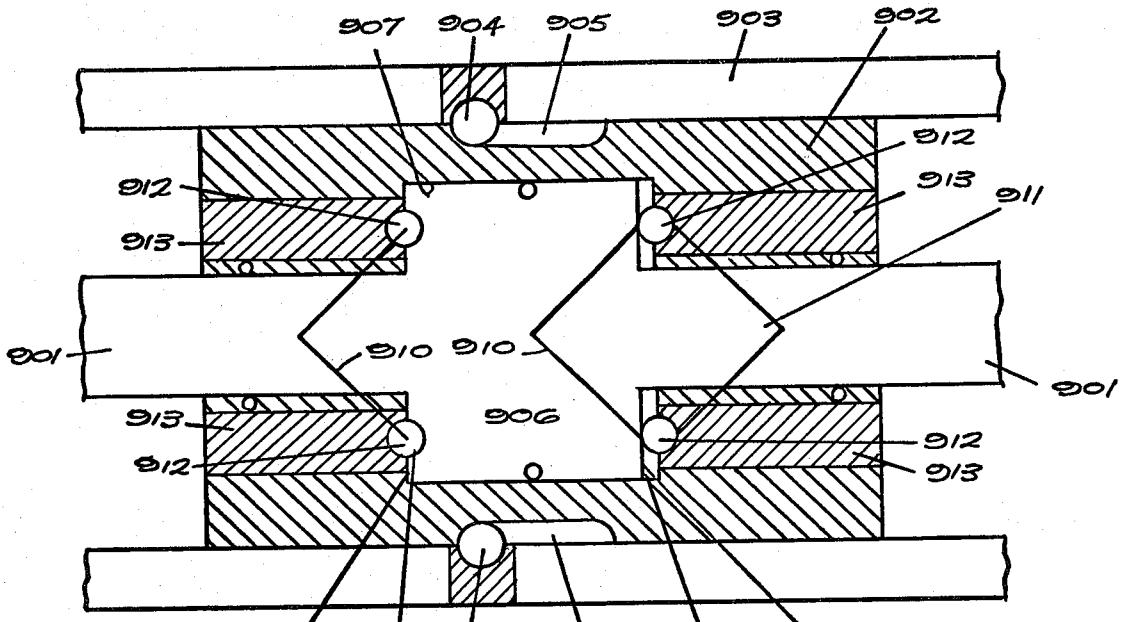
Figure 13B:
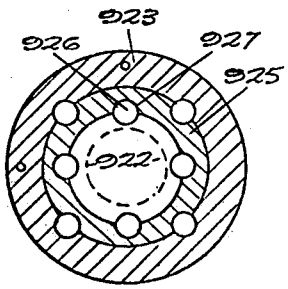
Figure 13C:
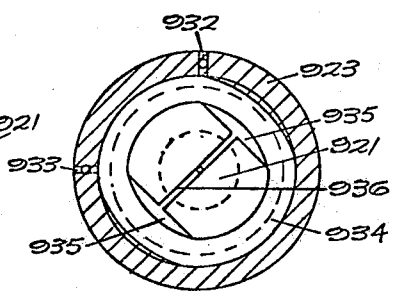
Figure 13:
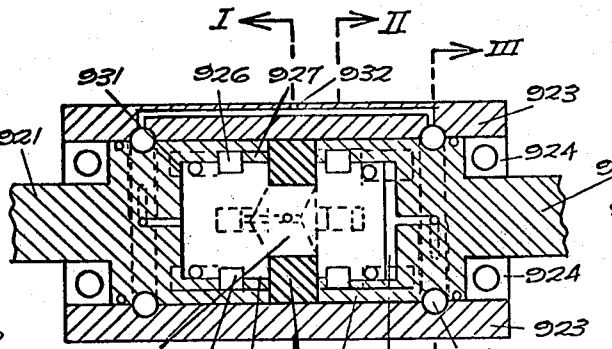
Figure 13A:
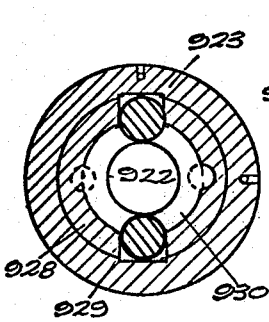
Figure 14A:
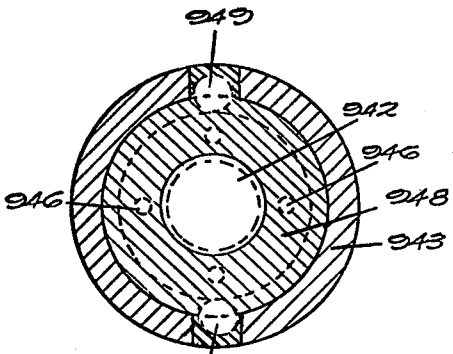
Figure 14:
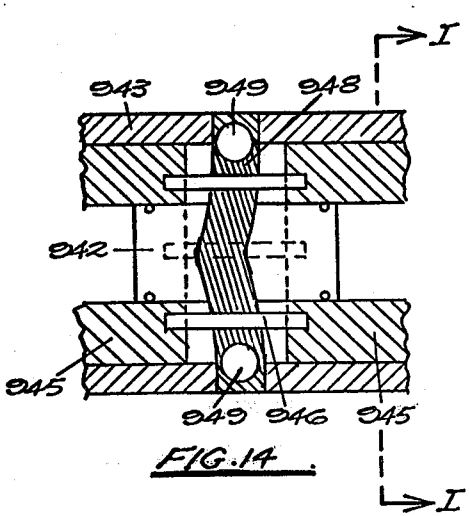

FIG. 6*a* is a cross-sectional view of the shaft along line I—I on FIG. 6;

FIG. 7 shows a longitudinal cross-section through a second further embodiment of engine or motor in accordance with the present invention which is a modification of the embodiment of FIG. 6;

FIGS. 8A to 8F show in longitudinal and cross-section, partly also in phantom, various features of another embodiment of motor in accordance with the present invention;

FIGS. 9A to 9E show in section different embodiments of sealing devices which may be used in sealing inlet and outlet ports in the various embodiments of the present invention;

FIG. 10 shows a longitudinal section through another form of device of this invention, FIG. 10A shows a transverse section along the line II—II of FIG. 10, while FIGS. 10B and 10C show a modified disc or ring for use in this form of the device;

FIG. 11 shows a longitudinal section through a further alternative form of device of this invention and FIG. 11A shows a transverse section along the line I—I of FIG. 11;

FIG. 12 shows a longitudinal section through an alternative form of coupling means which may be used, for example, in the device shown in FIG. 10;

FIG. 13 shows in longitudinal section a further form of device of this invention, FIGS. 13A to 13C showing transverse sections along lines I—I, II—II and III—III of FIG. 13 respectively; and FIG. 14 shows in longitudinal section a modification of the device of FIG. 13, FIG. 14A being a transverse section along line I—I of FIG. 14.

Figure 1:
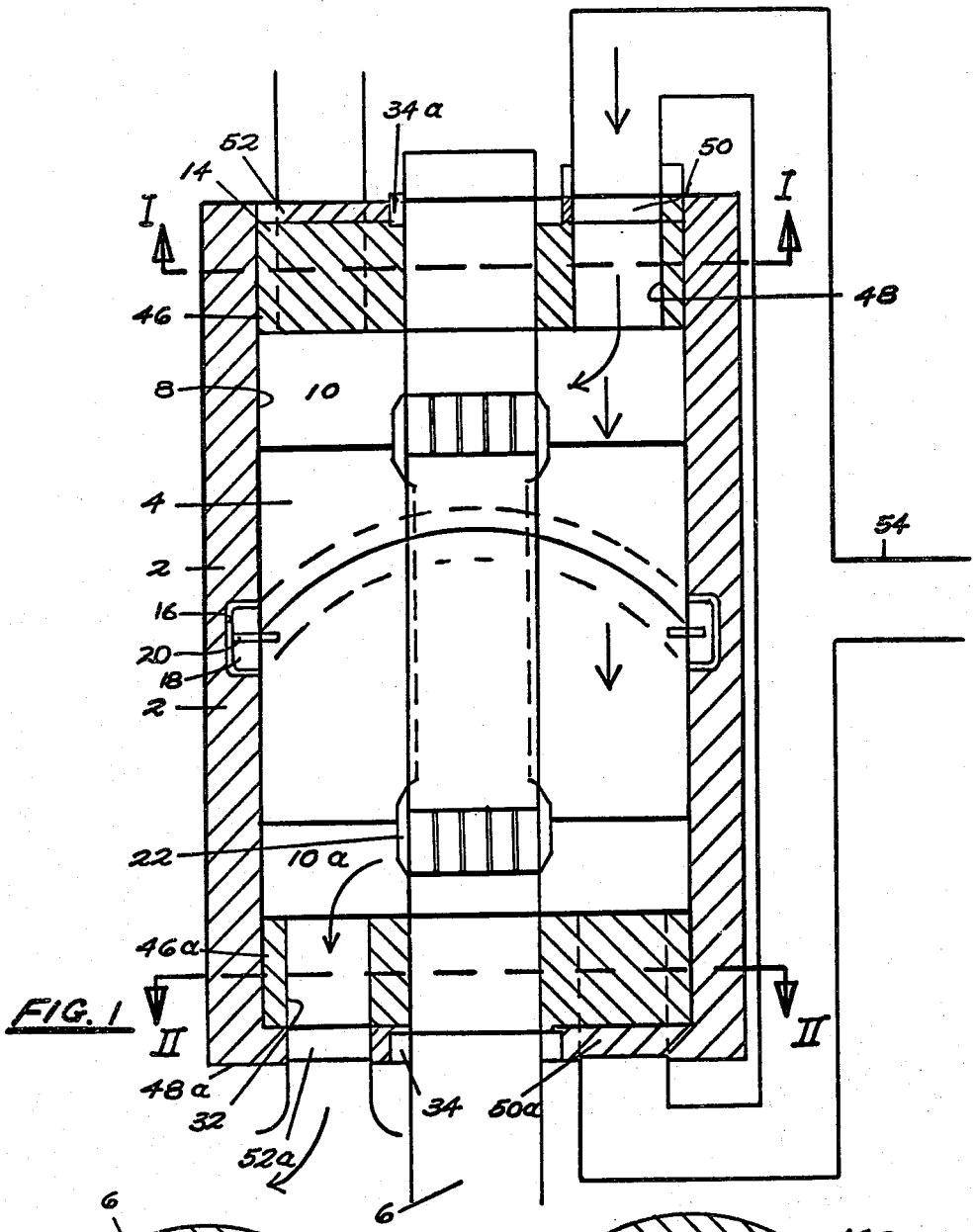
FIG. 1 shows a longitudinal cross-section through a simple form of motor constructed in accordance with the present invention.

The fluid operated motor illustrated in FIG. 1 comprises a cylinder 2, piston 4 and shaft 6 all of which are coaxial. The piston 4 is axially movable in the cylinder 2 and sealingly engages the interior cylindrical wall 8 thereof. Working chambers 10 and 10*a* are defined between the interior wall 8, the top end walls of the piston and the end walls of the cylinder. A working fluid introduced into the working chamber 10 will tend to move the piston 4 axially away from the end wall 14 of the cylinder when it expands or is caused to expand. The method of introducing the fluid into the chamber 10 will be described later.

As previously described, the working fluid may be either a fluid under pressure or a fluid which expands on ignition. In the first of these alternatives, the working fluid may comprise any compressible or incompressible fluid under pressure, for example, a pressurized pressurised gas such as air, helium, or steam or a pressurized liquid such as hydraulic oil. In order to assist expansion of such a pressurized fluid, the end wall 14 of the cylinder, or other area of the cylinder, may be externally heated. Where the working fluid requires ignition before it expands, the chamber 10 will of course be provided with a suitable ignition device which may be of any known type.

The inner wall 8 of the cylinder is formed with a sinusoidal or similar groove 16 which extends about a circumferential zone of the cylinder. The piston 4 is provided with a number of rollers or bearings 18 mounted upon radial stub axles 20, the rollers or bearings 18 being received within the groove 16. As will be apparent, axial reciprocation of the piston 4 under the influence of fluid in the working chambers 10 and 10*a* must be accompanied by rotation of the piston 4, the rollers 18 rolling along the sinusoidal groove 16. In a simple modification, the groove may be formed into the wall of the piston 4 and the rollers or bearings made to project from the inner wall 8 of the cylinder. A sinusoidal groove 16 ensures uniform rotation of the piston 4 but clearly a non-sinusoidal groove could be used if a non-uniform rotation of the piston was required or acceptable.

Shaft 6 is provided with splines 22 and is received within a splined recess through the piston 4, the intermeshing splines permitting axial movement of the piston 4 relative to the shaft 6 but constraining them to rotate in unison. Thus, as the piston 4 rotates under the influence of the fluid in the chambers 10 and 10*a*, the shaft 6 will be forced to rotate therewith. In a further simple modified form, the sinusoidal groove and rollers could be provided between the shaft and piston 4, and the splines provided between the cylinder and piston to achieve the same effect.

Figure 2:
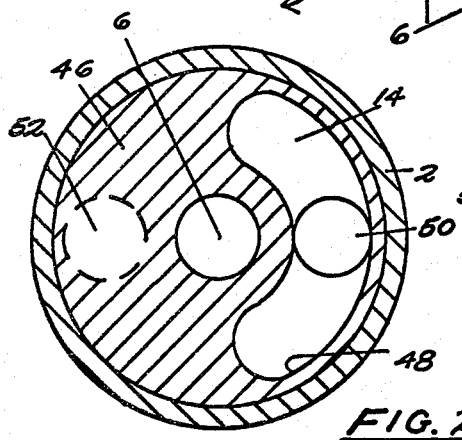
FIGS. 2 and 3 are cross-sectional views along the lines I—I and II—II respectively on FIG. 1, and show control discs for controlling fluid flow in the motor.
Figure 3:
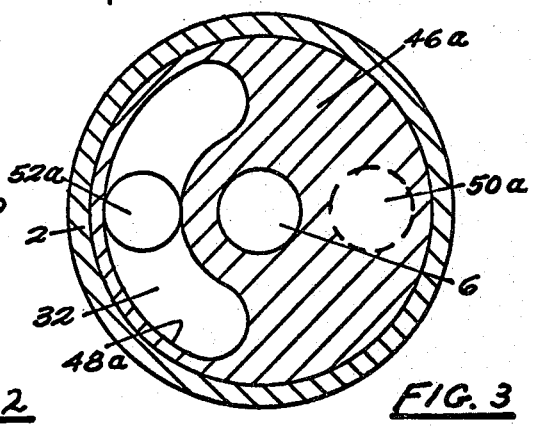

As previously described, the shaft 6 extends through the piston 4 and is supported by bearings 34 and 34*a* at either end of the cylinder. The shaft 6 carries a pair of control discs 46 and 46*a* which are disposed adjacent to respective ends 14 and 32 of the cylinder. As shown in FIGS. 2 and 3, each of the control discs 46,46*a* has a somewhat kidney shaped opening 48, 48*a* formed therethrough to alternately communicate the working chambers 10 and 10*a* with inlet and outlet ports 50, 50*a* and 52, 52*a* formed in the ends of the cylinder. The inlet ports 50,50*a* are connected to a common source of fluid under pressure by inlet duct 54 and the outlet ports 52,52*a* are vented to atmosphere in a pneumatic arrangement or to a return duct in an hydraulic arrangement. The relative positions of the openings 48, 38*a* are chosen such that one of the working chambers, such as 10 as seen in FIG. 1, is in communication with the input fluid duct 54 while the other working chamber 10*a* is open to its outlet port 52*a*. In half a revolution of the shaft 6 the arrangement will be in reverse, i.e., the working chamber 10*a* will be in communication with the inlet duct 54 and the working chamber 10 will be open to its outlet port 52. Kidney shape openings 48 and 48*a* are chosen so that the ports 50,50*a* and 52, 52*a* are open, at the appropriate times, for almost half a revolution of the shaft 6 but are shaped so that at the end of each stroke of the piston 6 all ports will be closed to avoid escape of pressurized fluid directly from the inlet ports 50, 50*a* to the outlet ports 52, 52*a*.

Figure 4:
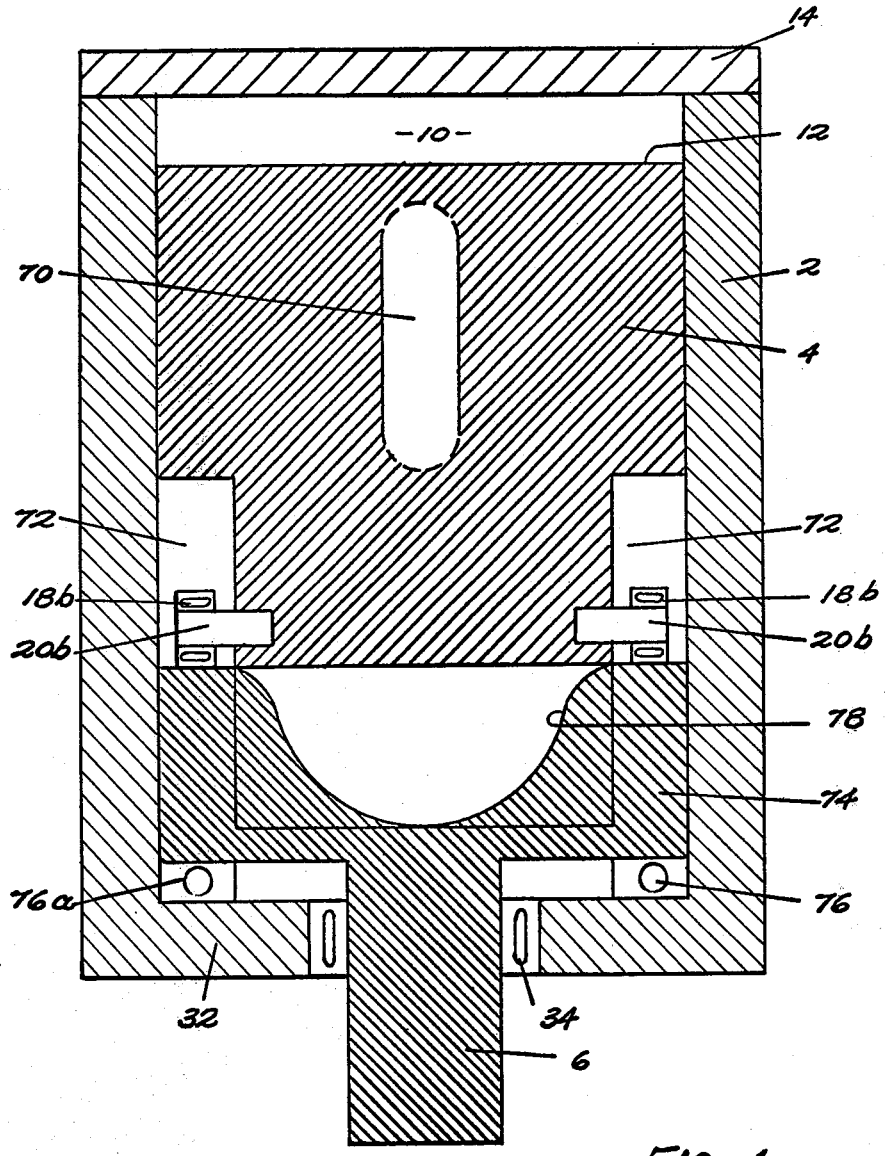
FIG. 4 shows a schematic longitudinal cross section through a simple motor which is an alternative form of FIG. 1.

FIG. 4 depicts a simple modification of the motor illustrated in FIG. 1 and which is basically operated in a manner described with reference to that Figure. In this modification, however, piston 4 is arranged to perform simple axial reciprocation only within cylinder 2, under the effect of working fluid introduced into working chamber 10 in the manner described in FIG. 1. Piston 4 is prevented from rotation in fact, by means of rollers (not shown) projecting axially inwards from the wall of cylinder 2 and engaging longitudinal slots 70 formed in the outer surface of piston 4. An annular recess 72 is provided at the lower end of piston 4 and a number of rollers 18*b* mounted on radial stub axles 20*b* are mounted on the piston 4 to extend radially into the recess 72. Shaft 6 is provided with an area 74 of increased diameter mounted within cylinder 2 for rotation therein supported by bearings 76, 76*a*. A longitudinally extending annular cam surface 78 is provided on area 74 in the form of a sinusoidal or similar surface around which rollers 18*b* move on axial reciprocation of piston 4, this movement of rollers 18*b* on surface 78 causing rotation of shaft 6 since piston 4 is constrained from rotation.

Figure 5:
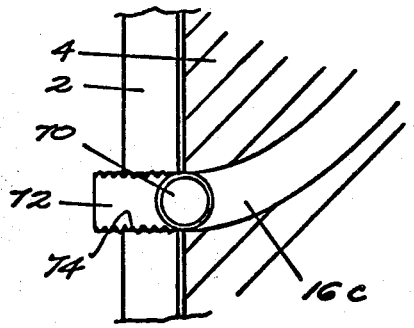
FIG. 5 illustrates an alternative form of coupling means which may be utilised in any of the embodiments illustrated in the previous Figures.

FIG. 5 of the drawings depicts schematically an alternative form of coupling means which may, if desired, be utilised in any of the above described embodiments. This alternative coupling means comprises a sinusoidal or similar groove 16*c* formed, for example in piston 4, and having semi-circular section. Projecting from, for example, the internal wall of cylinder 2 is bearing ball 70 which is received within the groove 16*c* for movement along this groove such that axial movement of the piston 4 relative to the cylinder 2 causes rotation of the piston relative to the cylinder. The bearing ball 70 is retained in position by plug 72 inserted in bore 74 in the wall of cylinder 2, the plug 72 being provided at one end thereof with a hemispherical or similar recess to engage ball 70. The plug 72 may be adapted for threaded engagement with bore 74 whereby adjustment of the ball 70 within groove 16*c* may be readily effected. Plug 72 may also, if desired, be provided with a suitable grease nipple or the like therethrough whereby lubricant may be provided to facilitate rotation of the ball 70 relative to the plug 72 and the groove 16*c*.

Referring now to FIG. 6 attached hereto, the engine or motor of this embodiment is particularly intended to operate as a two-stroke engine utilising as fuel petrol, petrol/oil mixtures or the like which provide an expanded volume of gas on ignition. Engine 100 of FIG. 6 comprises basically a cylinder 101, a pair of mutually opposed pistons 102 reciprocable and rotatable within the cylinder and a rotatable shaft 103 extending through and coaxial with both the cylinder 101 and the pistons 102, shaft 103 being mounted for rotation relative to cylinder 101 supported by bearings 104 in the end walls 105 of the cylinder.

Pistons 102, together with cylinder 101, define a main working chamber 106, the outer walls of the pistons sealingly engaging the inner walls of the cylinder 101. Similarly, pistons 102 sealingly engage the shaft 103 which they surround. Suitable sealing means are provided between the shaft and pistons and the pistons and cylinder.

A spark plug 107 or similar ignition device is provided in the main working chamber 106 for ignition of fuel/air mixtures admitted thereto. Inlet and outlet ports 108 and 109, are provided to allow introduction of fuel/air mixtures to the working chamber 106 and to allow exhausting of the working chamber. As illustrated in FIG. 6, on ignition of a fuel/air mixture in the working chamber 106, the mutually opposed pistons 102 are forced apart from one another, thereby diminishing the volume of the secondary working chambers 110. Movement of the pistons in this manner exposes the working chamber 106 to the inlet and outlet ports 108 and 109, previously closed by the outer walls of the pistons. In operating as a two-stroke engine, on completion of a first working stroke, working chamber 106 is exhausted and fresh fuel/air mixture admitted to the chamber through the ports 109 and 108 respectively. As pistons 102 move toward each other in a return stroke, the fresh fuel/air mixture is compressed as the volume of working chamber 106 is reduced in preparation for a further working stroke on actuation of the plug 107.

If desired, the return stroke whereby fresh fuel/air mixture is compressed in working chamber 106 may in fact be a working stroke of pistons 102 actuated by ignition of fuel/air mixture in secondary working chambers 110. Of course, in such an arrangement the chambers 110 would be provided with suitable ignition devices and inlet and outlet ports which are not shown in FIG. 6. Alternatively, the return stroke of the pistons 102 can be achieved using momentum of a flywheel or the like attached to shaft 103.

Translation of the basically axial reciprocation of the pistons 102 into rotation of shaft 103 is achieved by means previously described in accordance with the present invention. The outer wall of each of the pistons is formed with a sinusoidal or similar groove 111 which is only schematically depicted in FIG. 6. Groove 111 is of semi-circular cross section and one or more bearing balls 112 are mounted in the inner wall of cylinder 101 and received within the groove 111 for movement along the groove. It will be apparent that on axial reciprocation of pistons in the working and return strokes, movement of the balls 112 along groove 111 will result in rotation of the pistons 102 relative to the cylinder 101 as well as axial reciprocation. Bearing balls 112 are retained in position in the wall of cylinder 101 by means of plugs 113 having hemispherical or similar recesses to engage the balls. Pistons 102 are connected to shaft 103 by lost-motion devices which cause the shaft to rotate with the pistons but allow relative axial reciprocation of shaft and pistons. These devices comprise bearing balls 120 engaging semi-circular or similar longitudinal grooves 121 in the outer wall of shaft 103 (see FIG. 6A). Bearing balls 120 are retained in position relative to pistons 102 by plugs 122 having hemi-spherical or similar recesses to engage balls 120.

Where secondary chambers 110 are not used to provide a powered return stroke, these chambers may be provided with suitable valve arrangements to operate as oil or water pumps or the like during working of the engine 100.

FIG. 7 illustrates an alternative construction of engine or motor particularly intended to operate as a four stroke engine. In general, this embodiment is similarly constructed to the embodiment of FIG. 6 and it will be understood that features of this embodiment not illustrated may be as in FIG. 6.

The main constructional difference in FIG. 7 lies in the provision of cylindrical sleeve 140 mounted within recess 141 in the inner wall of cylinder 101 for rotation relative to the cylinder. Sleeve 140 is provided with one or more lost-motion devices in the form of bearing balls or rollers 150 received within recesses 151 between the sleeve and the adjacent cylinder wall, the balls 150 being received in longitudinal semi-circular grooves 152 in the outer walls of pistons 102. The lost-motion devices ensure that while pistons 102 are free to move axially relative to sleeve 140, rotation of the pistons will cause rotation of sleeve 140. A slot 142 is provided in the sleeve 140 such that in one rotary position of the sleeve, spark plug 107 is in communication with working chamber 106 through the slot. Inlet and outlet ports 143 and 144 (FIG. 7A) are provided at suitable positions around cylinder 101 so that rotation of sleeve successively communicates via slot 142, the working chamber 106 to exhaust port 144 at the end of the first working stroke and during the first return stroke of pistons 102, then to inlet port 143 during a second expansion of chamber 106 to admit fresh fuel/air mixture, this fresh mixture being compressed during a second return stroke in preparation for subsequent ignition by plug 107.

It will be apparent from a consideration of FIGS. 6,6A,7 and 7A that the use of two mutually opposed pistons as illustrated is of particular benefit in eliminating vibration. Nevertheless, it is to be understood that a single piston may be used, or alternatively further pistons may be added along the shaft and constructed and operated essentially as described above.

Referring now to FIGS. 8A to 8F there is illustrated in longitudinal section a motor 200 particularly suited for use with a compressed fluid such as compressed air, with steam or with fluid such as air which is alternately heated and cooled to cause expansion and contraction respectively.

Motor 200 comprises cylinder 201, piston 202 movable axially within cylinder 200, and a shaft 203 parallel to the axis of the cylinder 201 and piston 202 and extending therethrough. Shaft 203 is mounted in bearings 204 in the end walls 205 of the cylinder for relative rotation of the cylinder and shaft.

Piston 202 is provided on its outer wall with a sinusoidal or similar groove of semi-circular section which engages bearing balls mounted in the walls of cylinder 201 to couple the piston and cylinder in such a manner that axial reciprocation of the piston 202 causes relative rotation of the cylinder 201. Piston 202 is coupled to shaft 203 by means of bearing balls engaging longitudinal grooves in the outer wall of the shaft. This arrangement enables axial reciprocation of the piston relative to the shaft while preventing rotation of the piston relative to the shaft. Full details of these coupling means have been described above with reference to the embodiment of FIG. 6. Working fluid is admitted to working chamber 206 to force the piston 202 to move into the secondary chamber 210 in a working stroke and spent fluid exhausted from chamber 206 by rotary valve means 207 illustrated in more detail in FIGS. 8B to 8D.

Figure 8A:
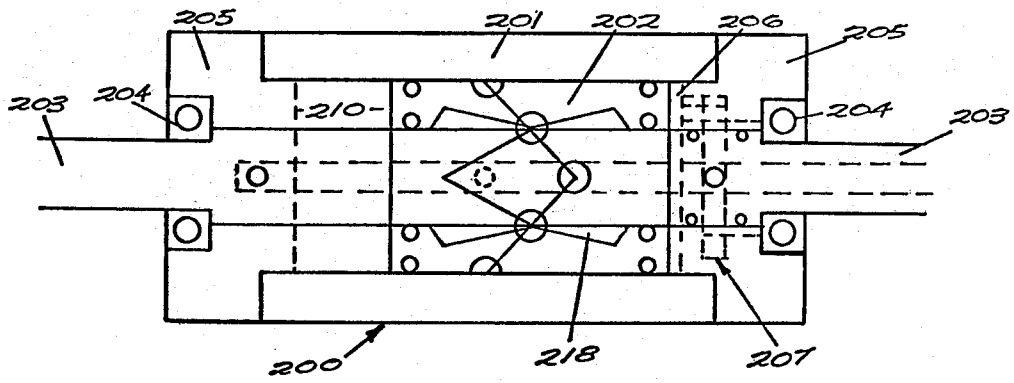
Figure 8B:
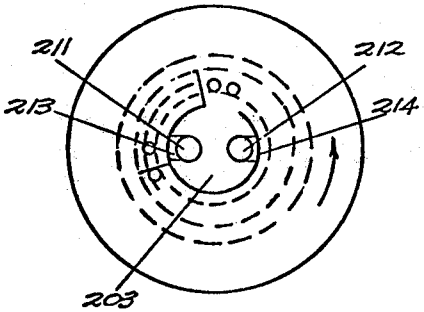
Figure 8C:
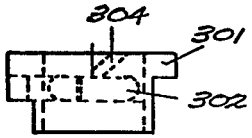
Figure 8D:
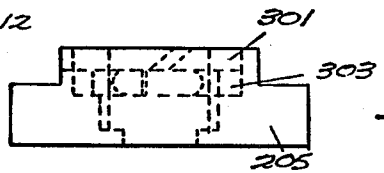
Figure 8F:
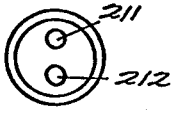
Figure 8E:
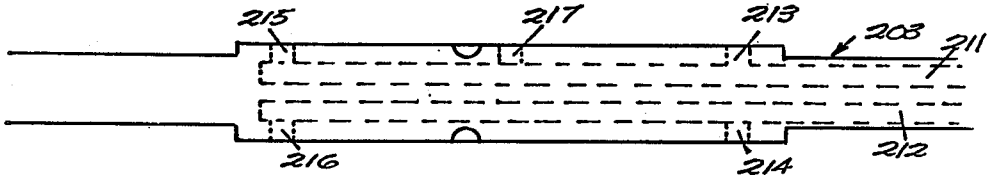

The construction of shaft 203 is illustrated in more detail in FIGS. 8E and 8F. Longitudinal passageways 211 and 212 are provided in shaft 203 for passage of working fluid to and from working chamber 206 (and secondary chamber 210 if the return stroke of the piston 202 is also to be a working stroke). Radially extending openings 213 and 215 are provided in the inlet passageway 211 and corresponding openings 214 and 216 are provided in the outlet passageway 212. The openings 213 and 214 are placed in communication with working chamber 206 by valving means 207 as described hereinafter. Inlet passageway 211 is provided with an additional radially extending opening 217 communicating with a fluid reservoir 218 (FIG. 8A) formed between piston 202 and shaft 203. In an alternative arrangement, inlet passageway 211 may be omitted and working fluid admitted to reservoir 218 through an inlet port in cylinder 210 communicating with a radial passageway extending through the outer wall of piston 202 to the reservoir. In this alternative arrangement, as the piston rotates relative to the cylinder, supply of working fluid to the reservoir will be intermittent. Furthermore, in this arrangement a longitudinal passageway will be provided extending through the shaft from the reservoir to the valving means to pass working fluid to the working chamber when required. The use of the reservoir in both of the above arrangements ensures that sufficient working fluid is available to be fed to the working chamber when required.

Valving means 207 is incorporated in end wall 205 of cylinder 201 and in the embodiment illustrated in FIGS. 8B to 8D comprises an annular portion 301 through which shaft 203 extends for rotation relative to the annular portion 301, the annular portion 301 being press fitted into the end wall 205 in which bearings 204 are mounted (see FIG. 8A) to support shaft 203 for rotation. As shown in FIG. 8A, annular portion 301 surrounds shaft 203 in such a manner that inlet and outlet openings 213 and 214 communicate with the inner surface of the annular portion. It will be apparent that if inlet and outlet openings 215 and 216 are provided in the shaft, a similar valving means will be provided to control passage of working fluid to and from secondary chamber 210.

Annular portion 301 is provided with a circumferential slot 302 adapted to communicate alternatively with openings 213 and 214 on rotation of the shaft, slot 302, communicating with a circumferential passageway 303 formed between the annular portion 301 and end wall 205. Opening 304 extends axially through portion 301 to communicate the passageway 303, at a point remote from slot 302, with the working chamber 206, the opening 304 being at an angle to the axis of the portion 301 as shown to admit working fluid to the chamber 206 in a circular direction and thus promote relative rotation of piston and cylinder.

In operation of the valving means 207, rotation of the shaft 203 relative to end wall 205 and annular portion 301 will successively communicate inlet opening 213 and outlet opening 214 with the working chamber 206 via slot 302, circumferential passageway 303 and axial opening 304, thereby enabling passage of working fluid to and from the chamber 206 through passageways 211 and 212 in the shaft.

In the valving arrangement of FIGS. 8A to 8D, inlet and outlet openings 213 and 214 are closed simply by an abutting relationship with the inner wall of annular portion 301. Whilst such a closure is effective for some applications, it is desirable in certain instances to provide for more positive sealing of these openings since a simple abutting relationship between the surfaces clearly permits loss of some working fluid, particularly when this fluid is under pressure, since the surfaces must be permitted to slide relative to one another during rotation.

FIGS. 9A to 9E illustrate various sealing devices which may be utilised to provide positive sealing of openings such as 213 and 214 in shaft 203 of FIGS. 8A to 8F. The sealing devices of these Figures are not, however, restricted to use in the embodiment of FIGS. 8A to 8F and it will be appreciated that they may be used where appropriate in any of the embodiments described in the present specification.

Figures 9A, 9B, 9C, 9D, 9E:
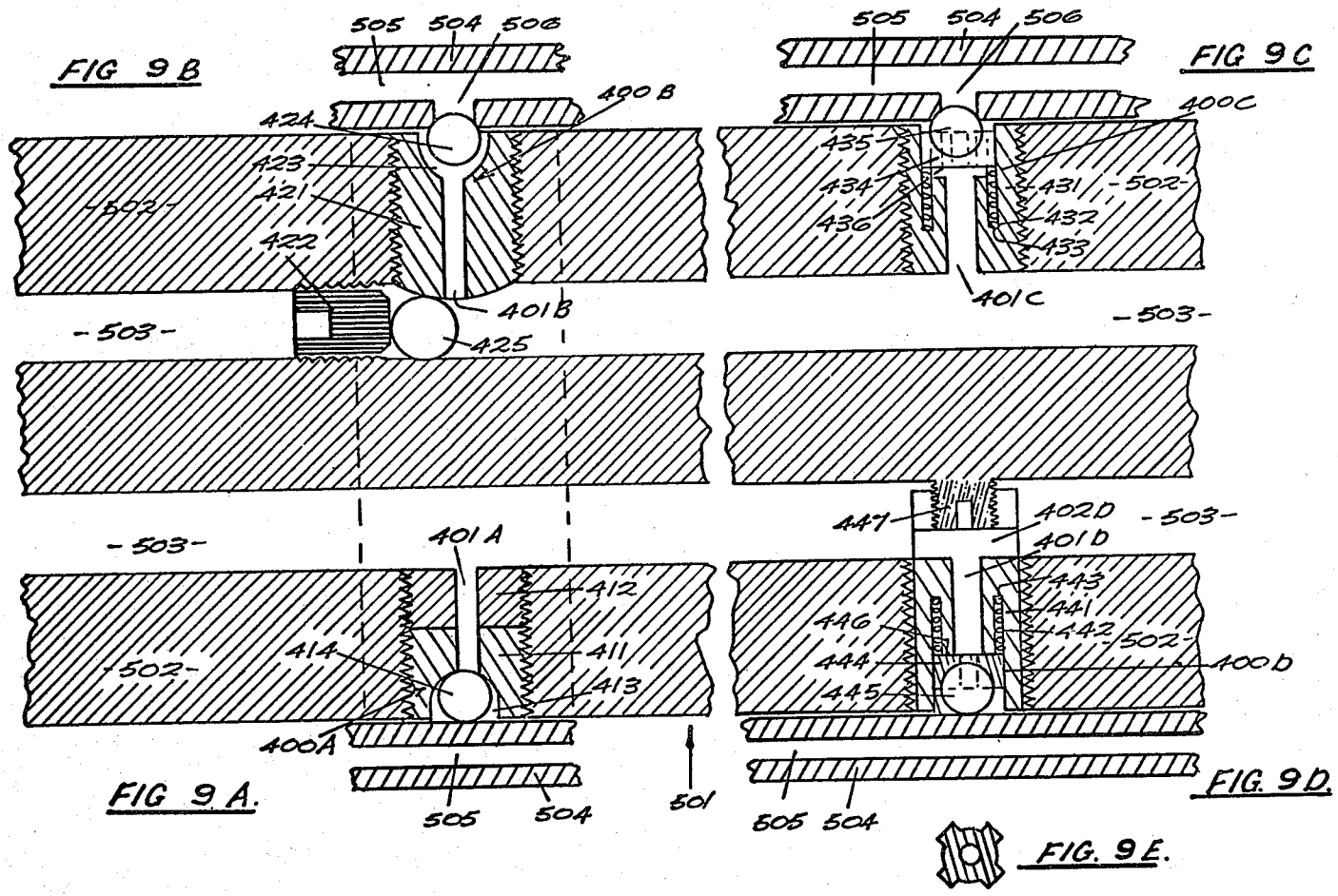

Referring firstly to FIG. 9A sealing means 400A are provided, for example in the wall 502 of a shaft 501 to provide a radially extending opening 401A between a passageway 503 extending longitudinally of the shaft 501 and the outer surface thereof. Passageway 503 may be either an inlet or an outlet passageway. Facing shaft 501 and in sliding abutting relationship thereto is annular portion 504 having a passageway 505 therein to be placed in communication with opening 401A through slot or opening 506 (see FIGS. 9A and 9D).

Sealing means 400A comprises two parts 410 and 411 each threadingly engaging wall 502 of shaft 501 and together defining opening 401A. Provision of two separate parts enables adjustment of the radial position of the outermost part 411 and locking thereof in position by interaction of that part with the innermost part 412. Outermost part 411 is provided with a hemispherical or similar recess 413 in which is located a bearing ball 414, this ball being adapted to abut and seal off opening 401A on contact of the ball with the innermost wall of annular portion 504 and to project partially into slot 506 when the position of the latter corresponds to the position of ball 414, thereby allowing communication of fluid between opening 401A and 505. It will be appreciated that where passageway 503 contains fluid under pressure, the pressure of the fluid will force ball 414 away from the opening 401A when the position of the ball corresponds to the position of the slot 506.

Sealing means 400B comprises a modified version of sealing means 400A, the modification being in the means for locking the outermost threaded part 421 thereof in position relative to wall 502 to allow radial adjustment of the position of bearing ball 424 contained in recess 423 to ensure proper operation of the ball in sealing and unsealing the opening 401B on relative movement of the shaft 501 and portion 504. Outermost threaded part 421 which defines opening 401B is domed at this innermost end, the domed end projecting into passageway 503 and engaging a second bearing ball 425 located therein. Ball 425 is forced into engagement with this domed end by second threaded part 422 of the sealing means which threadingly engages the wall of passageway 503. Sealing means 400B operates in the same manner as described above for sealing means 400A.

The sealing means 400C and 400D illustrated in FIGS. 9C and 9D are particularly, but not exclusively, designed for use in exhausting fluid under pressure from passageway 505, through slot 506 and into passageway 503.

Means 400C comprises threaded part 431 defining opening 401C, and threadingly engaging wall 502 for radial adjustment relative thereto. Spring 432 is provided within an annular recess 433 surrounding opening 401C, the spring engaging member 434 and urging it radially outwardly. Member 434 is provided with a hemispherical or similar recess to receive bearing ball 435 and is adapted to engage and seal opening 401C with its radially inner surface 436. It will be apparent that upon suitable adjustment of means 400C relative to wall 502, contact of ball 435 with the inner wall of portion 504 will hold surface 436 in sealing engagement with the opening 401C, however when the position of ball 435 corresponds to the position of slot 506, the ball will project into the slot to disengage surface 436 from the opening 401C and allow communication of fluid from passageway 505 through the opening. Member 435 is preferably formed as shown in FIG. 9E to provide passageways around the circumference thereof between the member and the part 431 for the movement of fluid.

The sealing means 400D illustrated in FIG. 9D operates and is constructed in a manner similar to means 400C. Main body portion 441 of means 400D threadingly engages the wall 502 and projects into passageway 503. A secondary opening 402D is provided through the projecting part of the body portion to allow passage of fluid through opening 401D to passageway 503 via opening 402D. A locking portion 447 is provided in the projecting part of body portion 441 and threadingly engaged therein so that the radial position of portion 441 may be retained by locking action resulting from engagement of locking portion 447 with the inside wall of passageway 503. Body portion 441 is provided with an annular recess 443 in which spring 442 is mounted, the spring engaging member 444 (see FIG. 9E) and urging bearing ball 445 received in a recess in member 444 radially outwardly. Opening 401D is sealingly engaged by inner surface 446 of member 444 when bearing ball 445 contacts the inner wall of portion 504, and passage of fluid from passageway 505 to passageway 503, via openings 401D and 402D, is enabled when ball 445 corresponds to and is urged to project into slot 506.

With reference to FIG. 10 attached hereto, the engine of this embodiment is particularly intended to operate in a similar manner to the engine illustrated in FIGS. 7 and 7A. Thus, cylinder 700 is provided with a spark plug or similar ignition device 701 and inlet and outlet ports 702 and 703 in the same manner as illustrated in FIGS. 7 and 7A. Cylinder 700 is preferably comprised of two parts **700*a* and 700*b* which are sealingly joined to assist in the assembly of the engine. Pistons 710 are reciprocally mounted within the cylinder 700 so as to form a working chamber 704 between the mutually opposed faces thereof and the inner wall of the cylinder. The outer walls of the pistons sealingly engage the inner walls of the cylinder 700. Similarly, pistons 720 sealingly engage the shaft 730 which extends through the cylinder 700 and the pistons 720 coaxial therewith, the shaft being mounted for rotation relative to cylinder 700 supported by bearings 711 in the end walls 710 of the cylinder 700**. Suitable sealing means are provided between the shaft and the pistons and the pistons and the cylinder.

Means (not shown) may also be provided for admission of additional fluid such as compressed air to the working chamber 704, prior to compression of the working fluid in this chamber, to increase the quantity of fluid in the chamber and thus increase the compression ratio of the engine.

Surrounding the shaft 730, is the disc or ring 740 shown in FIGS. 10 and 10A. This ring is connected to the shaft by a plurality of radially extending members 741, each of which is connected to the shaft 730 at one end thereof and to the ring 740 at the other end thereof. Preferably, the members 741 are retainingly received within appropriate recesses in the shaft 730 and the ring 740. Since the members 741 will rotate through the working chamber 704, it is advantageous that they be shaped or oriented to facilitate mixing of the fuel/air mixtures within the chamber 704 prior to ignition thereof.

As shown in FIG. 10A the ring 740 does not constitute a complete cylindrical member, and preferably it describes circumferentially only slightly more than three quarters of a complete circle. As shown in FIG. 10C, ring 740 is, in section, preferably T-shaped, the radially inwardly extending portion of the T-shape being provided with the recesses 742 to accommodate members 741, whilst the radially outer cross piece is adapted to be received within the recess 705 provided in the inner wall of cylinder 700.

Alternatively, ring 740 may be of other sectional shape including rectangular, semi-circular or the like.

In the modification shown in FIGS. 10B and 10C ring 740 is, in fact, a complete cylindrical member and a slot **740*a* is formed therein. It will be apparent from a consideration of the present embodiment that as the ring 740 is constrained to rotate with shaft 730 with respect to cylinder 700, the gap in ring 740 will successively communicate the working chamber between pistons 720 with the spark plug 701 and inlet and outlet ports 702 and 703 as provided communicating with the recess 705. The ring 740 and supporting members 741 are, of course, situated in and rotate within the working chamber of the engine so that expansion of working fluid within the chamber 704 will enhance the sealing of the ring 740 within the recess 705. This sealing may also be enhanced by spring action of the ring 740** itself.

Translation of the basically reciprocal motion of the pistons 720 during operation of the engine into rotation of the shaft 730 is achieved by means previously described in accordance with the present invention. In this embodiment, the outer surface of the shaft 730 is formed with sinusoidal or similar grooves 732 which are only schematically depicted in FIG. 10. Preferably, grooves 732 are of semi-circular section and one or more bearing balls 733 are mounted in hemispherical or similar recesses in plugs 721 in the pistons 720. It will be apparent that on axial reciprocation of pistons 720 in the working and return strokes of the engine, movement of the bearing balls 733 along the grooves 732 will result in rotation of the shaft relative to the pistons. The pistons 720 are connected to the cylinder by lost motion devices which ensure that the pistons 720 do not rotate relative to cylinder 700. Thus, pistons 720 are provided with semi-circular or similar longitudinal grooves 722 in the outer walls thereof. Bearing balls 723 are retained in position relative to the cylinder 700 by plugs 706 having hemispherical or similar recesses to engage the balls. It will thus be apparent that since the shaft 730 is caused to rotate relative to the pistons 720, and as pistons 720 are constrained from rotating relative to the cylinder 700, then the shaft 730 is thereby caused to rotate relative to the cylinder 700 also.

Particular advantages of this embodiment lie in the fact that the ring 740 as described above may be readily formed as by stamping or casting. Furthermore, since the cylinder may be formed in two parts as illustrated by parts **700*a* and 700*b* in FIG. 10 herein, assembly of the engine in accordance with this embodiment is simplified, particularly as the ring 740 is directly connected to shaft 730**. It will be readily apparent that as the cylinder may be formed in two parts as shown in the embodiment described herein, it may also be extended to comprise more than two parts with consequent alterations to the shaft and addition of additional pistons so that this embodiment of the invention enables construction of a "modular" engine in which additional modules may be added or removed as desired to increase or decrease the capacity of the engine. Thus, an additional piston could be added to the invention shown herein so as to provide an engine having two working chambers operating in a complementary manner.

The embodiment of the present invention depicted in FIGS. 11 and 11A is particularly intended for use with expandable fluid such as compressed air or particularly steam. As shown, the device is provided with three pistons and four working chambers however it will be appreciated that the number of pistons and working chambers may be varied as required without departing from the principles of the present invention. In this embodiment cylindrical sleeves 801 are mounted within recesses 802 in the inner wall of cylinder 800 for rotation relative to the cylinder. Sleeves 801 are provided with lost-motion devices in the form of bearing balls or rollers 803 received within recesses between the sleeves and the adjacent cylinder wall, the balls or rollers 803 being received in longitudinal semi-circular grooves 804 in the outer walls of pistons 805. These lost motion devices ensure that while pistons 805 are free to move axially relative to the sleeves 801, rotation of the pistons will cause rotation of the sleeves. Sleeves 801 are also provided on the radially outer walls thereof with a plurality bearing balls or rollers 806 which are spaced around the circumference of the sleeves so as to provide additional support for the sleeves and to assist rotation thereof relative to the cylinder 800. A slot 807 is provided in each sleeve 800 such that on rotation of the sleeve, working chambers 808 formed between the mutually opposed faces of pistons 805 are successively communicated with inlet and outlet ports 809 and 810 provided at suitable positions around the cylinder 800.

Rotation of pistons 805 in accordance with the embodiment of FIG. 11, is effected by means previously described in accordance with the present invention. The outer wall of each of the pistons 805 is formed with a sinusoidal or similar groove 810 which is only schematically depicted in FIG. 11. Groove 810 is of semicircular section and one or more bearing balls 811 are mounted in the inner wall of cylinder 800 and received within the groove 810 for movement along the groove.

In contrast with previous embodiments, shafts 820, 821 do not extend through the cylinder 800 coaxial therewith, but extend only through the end walls 812 mounted therein in bearings 813. Within the cylinder 800, the shafts are connected to annular sleeves 822 which are connected to adjacent pistons 805 by lost-motion devices 803, 804 as previously described. Sleeves 822 may be provided with slots similar to slots 807 so that the chambers formed between the pistons 805 and the end walls 812 can be utilized as working chambers also; for this purpose they are also provided with suitable inlet and outlet ports extending through the cylinder 800.

Referring to FIG. 12, there is illustrated an alternative means for coupling a shaft 901 to piston 902 whereby axial reciprocation of the piston 902 within the cylinder 903 will cause rotation of the shaft, whereas piston 902 is constrained from rotation relative to the cylinder by bearing balls or rollers 904 mounted in the cylinder wall and received in longitudinally extending grooves 905 in the outer wall of the piston. It will be appreciated that piston 902 may be caused to reciprocate axially by ignition of a working fluid for example as described with reference to FIG. 10.

Shaft 901, which is coaxial with piston 902, is provided with portion 906 of expanded diameter contained within a corresponding chamber 907 within the piston 902. Portion 906 thus provides longitudinally facing surfaces 908 at either end thereof. Surfaces 908 may be planar as shown at the right-hand side of FIG. 12 or provided with a recess or groove 909 of semi-circular or similar cross-section as shown at the left-hand side of FIG. 12. Surfaces 908 are shaped so as to form sinusoidal or similar cam surfaces 910 which are only schematically depicted in this Figure. Piston 902 is provided with complementary recesses 911, again schematically depicted in FIG. 12, to enable axial movement of the piston relative to the shaft during rotation of the shaft. Mounted in piston 902 are bearing balls or rollers 912, preferably in hemispherical or similar recesses in mounting plugs 913, which engage the cam surface 910 or are received within recess or groove 909 in this surface. Movement of balls or rollers 912 on the surface 910 on axial reciprocation of piston 902, will cause rotation of shaft 901 since piston 902 is constrained from rotation.

Turning to the embodiment illustrated in FIG. 13 there is illustrated a further alternative means for coupling a shaft 921 to piston 922 whereby axial reciprocation of the piston 922 relative to the cylinder 923 will cause rotation of the piston relative to the cylinder and, as a consequence, rotation of the shaft relative to the cylinder since the shaft is constrained from rotation relative to the piston. As in previous embodiments, piston 922 may be caused to reciprocate axially by ignition or by expansion of a working fluid as described in reference to previous Figures. Each of the shafts 921 does not extend through the cylinder 923 coaxial therewith, but extends only through the end walls mounted therein in bearings 924. Within the cylinder, the shafts are connected to annular sleeves 925 which surround piston 922 at either end thereof and are coupled thereto to prevent relative rotation between the shaft and the piston by means of bearing rollers 926 received within the longitudinally extending grooves 927 formed on the inner rolls of the annular sleeves 925.

The axially inner ends of the sleeves 925 abut a radially inwardly extending portion of the cylinder 928 in which are mounted bearing rollers 929 which are received within a sinusoidal groove 930 (depicted schematically in FIG. 13) formed in the outer surface of piston 922. The bearing rollers 929 are retained in position in the portion 928 of the cylinder by the abutting relationship of the annular sleeves 925 so that, on axial reciprocation of the piston 922, the piston will be caused to rotate by the movement of the bearing roller 929 along the groove 930.

FIGS. 13 and 13C particularly illustrate an alternative arrangement for admission and exhaustion of a working fluid to the working chambers 931 at the ends of piston 922. This valving arrangement comprises inlet and exhaust passageways 932 and 933 communicating with respective inwardly directed ports towards either end of the cylinder 923. Each of shafts 921 is provided with a sealing ring such as an O ring 934 mounted within appropriate circumferential grooves in the shaft 921 and the cylinder 923, the inlet and outlet ports of passageways 932 and 933 terminating in the grooves in the cylinder 923 and being sealed by the O ring therein. As illustrated in FIG. 13C, the groove in the shaft 921 within which O ring 934 is mounted is provided with deeper sections 935 such that the O ring 934 which is stretched around the groove is not forced outwardly at these points. Accordingly, on rotation of the shaft, the ports from the passageways 932 and 933 which are sealed by the O ring at some rotational positions thereof, are not sealed at other rotational positions thereof since the O ring is not forced against the ports at these positions. Accordingly, fluid may move from the passageway 932 past the O ring 934 and into the working chamber 931 via the passageway 936 within the shaft. Similarly, expended working fluid may move via passageway 936, around O ring 934 and out passageway 933 at the appropriate rotational position of the shaft. To assist movement of the working fluid around the O ring, the groove in the shaft within which the O ring 934 is mounted may be widened, as well as depended, at the points 935.

FIG. 14 illustrates a modification of FIG. 13 in that, while the majority of the features thereof are as illustrated in FIG. 13, in this Figure a radially outwardly projecting portion 948 is provided on piston 942 in place of the inwardly directed portion 928 on cylinder 923 of FIG. 13. A sinusoidal guideway is provided in the radially outer surface of the portion 948 and this surface receives bearing balls 949 which are mounted in the wall of the cylinder 943. In this embodiment, the inward ends of the annular sleeves 945 which are attached to the shafts (not shown) are connected by longitudinally extending pins 946 which slideably extend through the portion 948 so that axial reciprocation of the piston 942, which results in rotation of the piston also by virtue of movement of the ball 949 along the sinusoidal guideway, will transmit the rotation of the annular sleeves and thus the shafts without causing axial reciprocation of the sleeves.

It will be appreciated many modifications and variations may be made to the embodiments disclosed herein without departing from the spirit and scope of the present invention.

The claims defining the invention are as follows:

1. A fluid operated device comprising: a cylinder member, at least two mutually opposed piston members movable axially therein, a common working chamber within said cylinder member defined by opposing ends of said piston members and the inner wall of said cylinder member, said cylinder member being provided with inlet means and outlet means communicating with said working chamber for admission of working fluid to said chamber and for removal of spent working fluid from said chamber, respectively; a shaft member extending through said piston members and said cylinder member concentrically with said members, first coupling means coupling the piston members to one of the other mentioned members such that axial reciprocation of the piston members causes rotation of the piston members relative to said one of the other mentioned members; second coupling means coupling the piston members to the other one of the other mentioned members to prevent relative rotation of the piston members and said other one of the other mechanical members while permitting axial reciprocation of the piston members; and valve means in said working chamber operatively coaxially coupled to said shaft member for rotation with said shaft member relative to the cylinder member, said valve means comprising a substantially cylindrical ring member having an aperture therein which, on rotation of said valve means, selectively communicates with said inlet means and said outlet means in said cylindrical member to control movement of working fluid into and out of said working chamber through said inlet and outlet means.

2. A fluid operated device as defined in claim 1, wherein said first coupling means comprises a continuous sinusoidal guideway means formed in a surface of each piston member and associated cam followers mounted in a facing surface of said cylinder member to project therefrom and engage each guideway means.

3. A fluid operated device as defined in claim 1, wherein said first coupling means comprises continuous sinusoidal guideway means formed in a surface of said cylinder member and an associated cam follower mounted in a facing surface of each piston member to project therefrom and engage each guideway means.

4. A fluid operated device as defined in claim 1, wherein said second coupling means comprises an axially extending guideway formed in a surface of each piston member and associated cam followers mounted in a facing surface of said shaft member to project therefrom and engage each guideway.

5. A fluid operated device as defined in claim 1, wherein said second coupling means comprises axially extending guideways formed in a surface of said shaft member and at least one associated cam follower mounted in a facing surface of each piston member to project therefrom and engage each guideway.

6. A fluid operated device as defined in claim 1, wherein ignition means are provided in the working chamber to ignite working fluid emitted to the chamber.

7. A fluid operated device as defined in claim 1, wherein said first coupling means comprises continuous sinusoidal guideway means formed in a surface of each piston member and associated cam followers mounted in a facing surface of said shaft member to project therefrom and engage such guideway means.

8. A fluid operated device as defined in claim 1, wherein said first coupling means comprises continuous sinusoidal guideway means formed in a surface of said shaft member and at least one associated cam follower mounted in a facing surface of each piston member to project therefrom and engage each guideway means.

9. A fluid operated device as defined in claim 1, wherein said second coupling means comprises at least one axially extending outwardly formed in a surface of each piston member and associated cam followers mounted in a facing surface of said cylinder member to project therefrom and engage each guideway.

10. A fluid operated device as defined in claim 1, wherein said second coupling means comprises axially extending guideways formed in a surface of said cylinder member and at least one associated cam follower mounted in a facing surface of each piston member to project therefrom and engage each guideway.

* * * * *